US011980266B2

(12) United States Patent
Du

(10) Patent No.: US 11,980,266 B2
(45) Date of Patent: May 14, 2024

(54) PUSH-TYPE CARD HOLDER

(71) Applicant: Xue Du, Xuzhou (CN)

(72) Inventor: Xue Du, Xuzhou (CN)

( * ) Notice: Subject to any disclaimer, the term of this patent is extended or adjusted under 35 U.S.C. 154(b) by 163 days.

(21) Appl. No.: 17/883,782

(22) Filed: Aug. 9, 2022

(65) Prior Publication Data

US 2024/0049848 A1 Feb. 15, 2024

(51) Int. Cl.
*A45C 11/18* (2006.01)

(52) U.S. Cl.
CPC ..... *A45C 11/182* (2013.01)

(58) Field of Classification Search
CPC ..... A45C 11/182
See application file for complete search history.

(56) References Cited

U.S. PATENT DOCUMENTS 4,852,727 A * 8/1989 Oberle ..... B42F 17/30 206/556
10,893,731 B2 * 1/2021 Wingerter ..... B42F 17/32
11,344,091 B2 * 5/2022 Goodwin ..... A45C 13/185
2022/0061485 A1 * 3/2022 Rodriguez ..... G09F 3/207
2023/0312918 A1 * 10/2023 Wang ..... C08L 69/00 524/166

FOREIGN PATENT DOCUMENTS

CN 204169237 U * 2/2015

* cited by examiner

*Primary Examiner* — Tri M Mai
(74) *Attorney, Agent, or Firm* — Jeenam Park

(57) ABSTRACT

A push-type card holder comprising a holder body, a holder cover and a card pushing assembly, which is arranged in the holder body and comprises a first and a second drive rod, the first drive rod is arranged above the second drive rod; the card pushing assembly comprises a limit rod arranged above the first drive rod by a fixed column, and can rotate around the fixed column; the card pushing assembly comprises a push rod arranged below the second drive rod, the push rod is provided with at least one step, and can be rotated relative to the second drive rod. The present application has a simple structure, the distributed push-out of the card can be realized without a spring structure, and the card is not easy to be stuck.

9 Claims, 4 Drawing Sheets

PUSH-TYPE CARD HOLDER

TECHNICAL FIELD

The present application belongs to the technical field of card holders, and in particular relates to a push-type card holder.

BACKGROUND

Card is a small, rectangular-shaped item that is used to carry information or entertainment, such as business cards, phone cards, postcards, ID cards, bank cards, poker, etc., which are essential item in daily life. For the convenience of carrying, people will put the card in the card holder, and take out the card from the card holder when using. For the convenience of taking out the card, the card holder in the prior art generally needs elastic components for transmission. Once the card case with this structure is used for many times, the elastic transmission components will be easily aged, and there will be a fault that the card cannot be pushed smoothly or even cannot be pushed out, which affects the user experience.

SUMMARY

In order to solve the problems raised in the above background art. The present application provides a push-type card holder, which has the characteristics of simple structure, decentralized push-out of cards without the need of a spring structure, and cards not easily stuck.

To achieve the above purpose, the application provides the following technical solutions:

A push-type card holder comprising a holder body, a holder cover and a card pushing assembly, the card pushing assembly is arranged in the holder body.

As a further description of the above technical solution: the card pushing assembly comprises a first drive rod and a second drive rod, the first drive rod is arranged above the second drive rod.

As a further description of the above technical solution: the card pushing assembly further comprises a limit rod, which is arranged above the first drive rod by means of a fixed column, and can rotate around the fixed column as a rotating shaft.

As a further description of the above technical solution: the card pushing assembly further comprises a push rod, the push rod is arranged below the second drive rod, the push rod is provided with at least one step, and can be rotated relative to the second drive rod.

As a further description of the above technical solution: the card pushing assembly further comprises a push rod, the push rod is arranged below the second drive rod, the push rod is provided with at least one step, and can be rotated relative to the second drive rod.

As a further description of the above technical solution: the first drive rod moves downward until it abuts against the second drive rod, and drives the second drive rod to move downward and the limit rod rotates in a direction close to a first limit block, and the second drive rod abuts against one end of the push rod and drives the push rod to rotate, and an included angle between the push rod and the second drive rod is reduced.

As a further description of the above technical solution: the holder body is further provided with a first limit block and a second limit block, and the limit rod is arranged between the first limit block and the second limit block.

As a further description of the above technical solution: the limit rod is an arc rod.

As a further description of the above technical solution: an end of the first drive rod close to the limit rod is a wedge-shaped structure with a narrow upper part and a wider lower part.

As a further description of the above technical solution: the card pushing assembly further comprises a fixed seat, and one end of the push rod close to the second drive rod is rotatably connected to the fixed seat by means of a push shaft.

As a further description of the above technical solution: a push boss is provided at end of the second drive rod close to the push rod.

As a further description of the above technical solution: the card pushing assembly further comprises a buffer mechanism, and the buffer mechanism is arranged below the limit rod and is detachably connected to the first drive rod.

As a further description of the above technical solution: two sides of the holder body are provided with folded edges, the folded edges of one side are provided with push slot, and the folded edges of the other side are provided with a first installation slot.

As a further description of the above technical solution: the holder cover is provided with a second installation slot corresponding to the first installation slot.

Compared with the prior art, the beneficial effects of the present application are:

The present application provides a push-type card holder, which can push out and place cards without elastic components for transmission, avoids damage to the card holder caused by the aging of elastic components caused by relying on elastic components for transmission, and saves maintenance costs and replacement costs, protect the environment, and the structure is simple, easy to install and maintain.

Further, when the holder body accommodates cards, the cards will not leak out due to the action of the limit rod, and because the push rod is provided with at least one step, the cards in the holder body can be pushed out dispersedly, which increases the applicable scene and user experience of the card holder.

Further, the end of the first drive rod close to the limit rod is configured to be a wedge-shaped structure with a narrow upper part and a wider lower part. In this way, the direction of the force applied by the first drive rod to the limit rod can form an included angle with the axial direction of the fixed column, so as to ensure that the limit rod will surely rotate around the fixed column as a rotating shaft, when the first drive rod pushes the limit rod. And when the first drive rod is tenoned with the limit rod, the wedge-shaped structure of the first drive rod will lock the limit rod, so as to achieve the technical effect of avoiding the accidental rotation of the limit rod and the leakage of the card from the holder body.

BRIEF DESCRIPTION OF DRAWINGS

In order to illustrate the technical solutions of the embodiments of the present application more clearly, the following briefly introduces the accompanying drawings used in the description of the embodiments. Obviously, the drawings in the following description are only some embodiments of the present application. For those of ordinary skill in the art, other drawings can also be obtained from these drawings without any creative effort.

REFERENCE SIGNS

Figure 1:
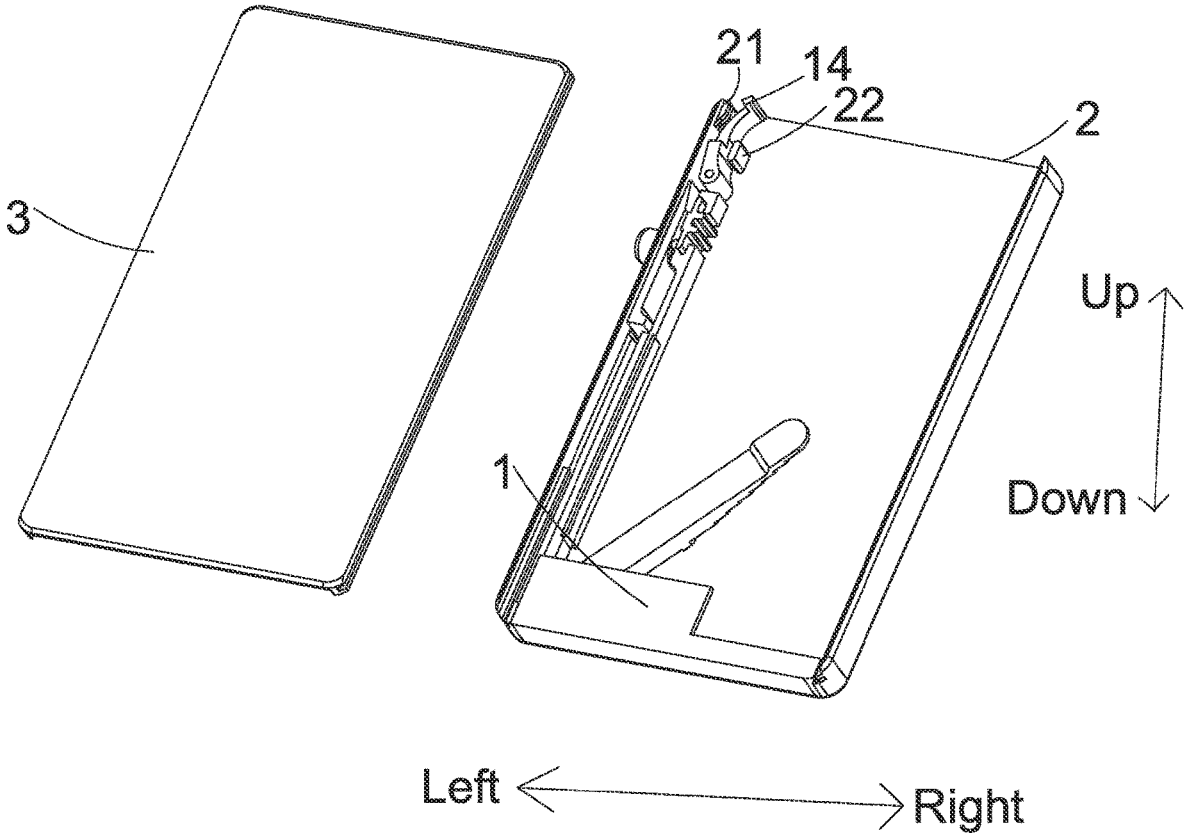
FIG. 1 is a schematic diagram of the overall structure of a push-type card holder according to the present application.

1 Push card assembly
11 Second drive rod
12 Push rod
13 First drive rod
131 Button
14 Limit rod
15 Buffer mechanism
16 Fixed seat
17 Push rod
18 Push boss
2 Holder body
21 First limit block
22 Second limit block
23 Fixed column
24 Mounting block
25 Mounting rod
26 First installation slot
27 Push slot
3 Holder cover
31 Positioning column
32 Second installation slot

DETAILED DESCRIPTION

The technical solutions in the embodiments of the present application will be clearly and completely described below with reference to the drawings in the embodiments of the present application. Obviously, the described embodiments are only a part of the embodiments of the present application, but not all of the embodiments. Based on the embodiments in this application, all other embodiments obtained by those of ordinary skill in the art without creative efforts shall fall within the protection scope of this application.

Please refer to FIGS. 1 to 4, the present application provides the following technical solutions:

Referring to FIG. 1, a push-type card holder comprises a holder body 2, a holder cover 3 and a card pushing assembly 1, and the card pushing assembly 1 is arranged in the holder body 2.

Further, the card pushing assembly 1 comprises a limit rod 14, the holder body 2 is provided with a first limit block 21 and a second limit block 22, and the limit rod 14 is arranged between the first limit block 21 and the second limit block 22, in this way, the movement range of the limit rod 14 is limited, so that even if the limit rod 14 is not provided with an elastic member, the situation that the limit rod 14 cannot return to its normal position due to the excessive movement range of the limit rod 14 will not occur.

Figure 2:
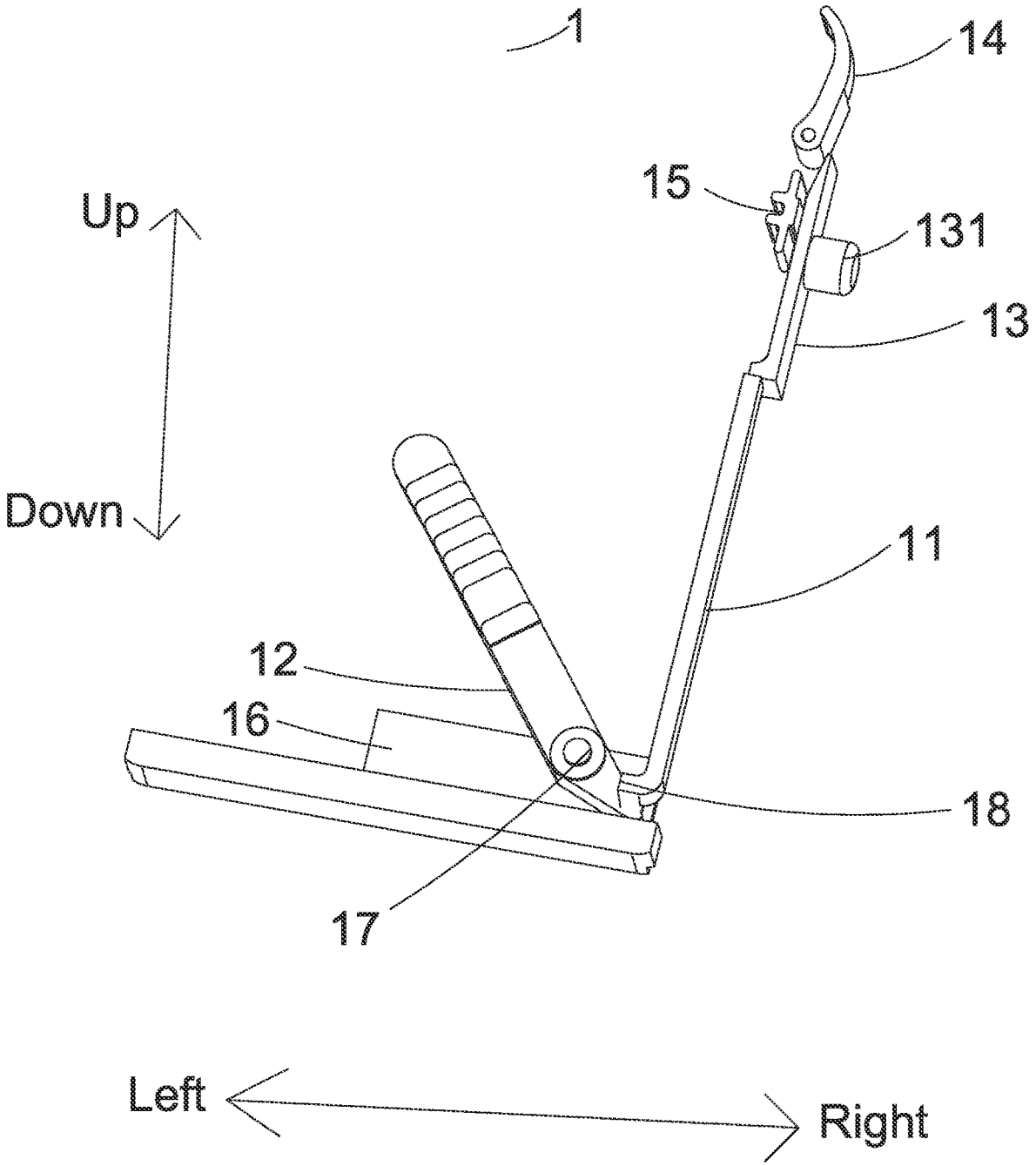
FIG. 2 is a schematic structural diagram of a card pushing assembly of a push-type card holder according to the present application.

Further, please refer to FIG. 2, the card pushing assembly 1 further comprises a first drive rod 13 and a second drive rod 11, the first drive rod 13 is arranged above the second drive rod 11, and when the first drive rod 13 moves downward, it will abut against the second drive rod 11.

In one embodiment, in order to facilitate the user's operation, a button 131 is fixed on the first drive rod 13, the button 131 is arranged outside the holder body 2, and the button 131 is toggled upward. When the button 131 is pushed upward, the first drive rod 13 moves upward, and when the button 131 is pushed downward, the first drive rod 13 moves downward.

Further, the limiting rod 14 can rotate relative to the first drive rod 13.

In one embodiment, the limit rod 14 is an arc rod, so that the limit rod 14 can move more smoothly during the transmission process.

In one embodiment, in order to ensure the accuracy of the transmission between the first drive rod 13 and the limit rod 14, the end of the first drive rod 13 close to the limit rod 14 is a wedge-shaped structure with a narrow upper part and a wider lower part. The size of the first drive rod 13 at the smallest width is smaller than the distance between the limit rod 14 and the left side of the holder body 2, and the size of the first drive rod 13 at the largest width is greater than the distance between the limit rod 14 and the left side of the holder body 2. In this way, the direction of the force applied by the first drive rod 13 to the limit rod 14 can form an included angle with the axial direction of the fixed column 23, so as to ensure that the limit rod 14 will surely rotate around the fixed column 23 as a rotating shaft, when the first drive rod 13 pushes the limit rod 14. And when the first drive rod 13 is tenoned with the limit rod 14, the wedge-shaped structure of the first drive rod 13 will lock the limit rod 14, so as to achieve the technical effect of avoiding the accidental rotation of the limit rod 14 and the leakage of the card from the holder body 2.

Further, the card pushing assembly 1 further comprises a push rod 12, and the push rod 12 is arranged below the second drive rod 11.

In one embodiment, the card pushing assembly 1 further comprises a fixed seat 6. In order to facilitate maintenance, the fixing seat 16 is detachably connected to the holder body 2. One end of the push rod 12 close to the second drive rod 11 is rotatably connected to the fixed seat 16 by means of a push shaft 17. In this way, when the second drive rod 11 pushes the end of the push rod 12 close to the second drive rod 11, the push rod 12 will rotate around the push shaft 17 as a rotating shaft.

In one embodiment, in order to facilitate the cards in the holder body 2 to be smoothly pushed out in a distributed manner, the push rod 12 is provided with at least one step and can rotate relative to the second drive rod 11.

In one embodiment, the number of steps on the push rod 12 can be set according to the number of cards that can be accommodated in the holder body 2, so that the cards can be pushed out one by one.

In one embodiment, the steps on the push rod 12 are evenly spaced apart.

In another embodiment, in order to further prevent the card from being stuck by the push rod 12, the distance between the step on the push rod 12 that is farthest from the second drive rod 11 and the step on the push rod 12 away from the second drive rod 11 is greater than the distance between the rest of the steps.

Further, the end of the second drive rod 11 close to the push rod 12 is provided with a push boss 18, which increases the contact area between the second drive rod 11 and the push rod 12. This increases the reliability of the transmission between the second t drive rod 11 and the push rod 12.

In one embodiment, the second drive rod 11 and the pushing boss 18 are integrally formed.

In one embodiment, the pushing boss 18 is formed by bending the second drive rod 11.

Further, in order to adjust the moving speed of the button 131 and prevent the card from being stuck or unable to be pushed out in a distributed manner due to the too fast movement of the button 131, the card pushing assembly 1 further comprises a buffer mechanism 15, and the buffer mechanism 15 is arranged below the limit rod 14, and is detachably connected with the first drive rod 13.

In one embodiment, in order to facilitate the installation of the buffer mechanism 15, the holder body 2 is provided with a mounting block 24 and a mounting rod 25, wherein the mounting block 24 is arranged below the fixed column 23, and the mounting rod 25 is arranged below the mounting block 24. Both the mounting block 24 and the mounting rod 25 are preset with mounting slot for accommodating the buffer mechanism 15.

Further, the buffer mechanism 15 is made of elastic materials such as rubber, silicone, and foam.

Figure 3:
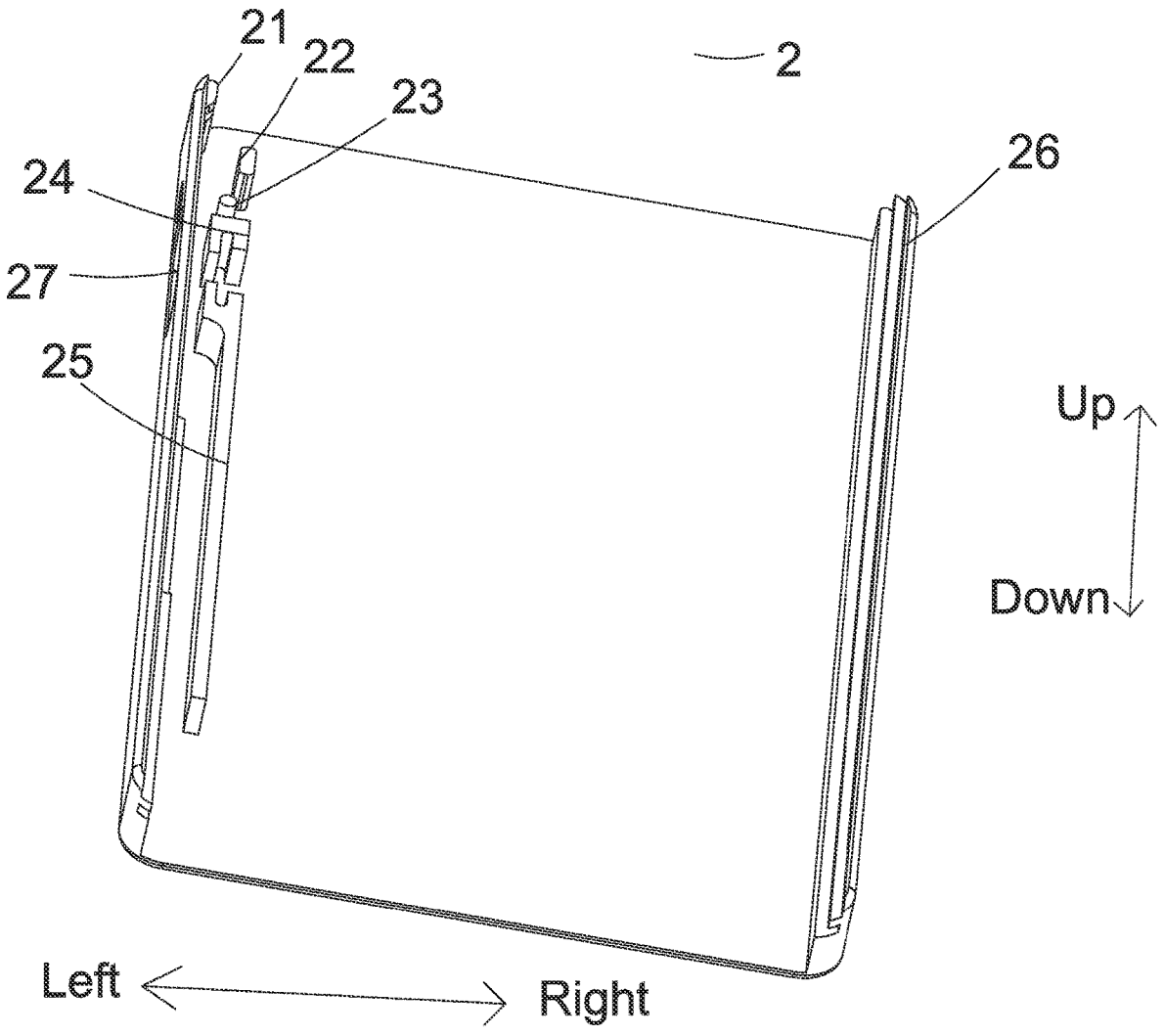
FIG. 3 is a schematic structural diagram of the holder body of a push-type card holder according to the present application.

Referring to FIG. 3, in one embodiment, the left and right sides of the holder body 2 are provided with folded edges, and the folded edges on the left and right sides of the holder body 2 form a through slot at the top of the upper end of the holder body 2 that can accommodate cards in and out.

Further, the folded edge on the left side of the holder body 2 is provided with a push slot 27 for placing the first drive rod 13 and the button 131. For the convenience of operation, the first drive rod 13 is provided on the right side of the push slot 27. The button 131 is disposed on the left side of the push slot 27, and the button 131 can move up and down along the push slot 27.

Further, a first installation slot 26 is arranged on the folded edge on the right side of the holder body 2 for cooperating with the holder cover 3 for installation.

In one embodiment, in order to facilitate the installation of the limit rod 14, a fixing column 23 is fixed on the holder body 2, the fixing column 23 is arranged above the mounting block 24. The limiting rod 14 is arranged above the first drive rod 13 by means of the fixed column 23, and can rotate around the fixed column 23 as a rotating shaft.

Further, in order to limit the movement track of the second drive rod 11 and its installation and positioning, the mounting rod 25 is also provided with a rod body, and the second drive rod 11 is arranged in a gap between the rod body and the left folded edge of the holder body 2. The push boss 18 is arranged below the rod body, and the installation is very intuitive and convenient.

Figure 4:
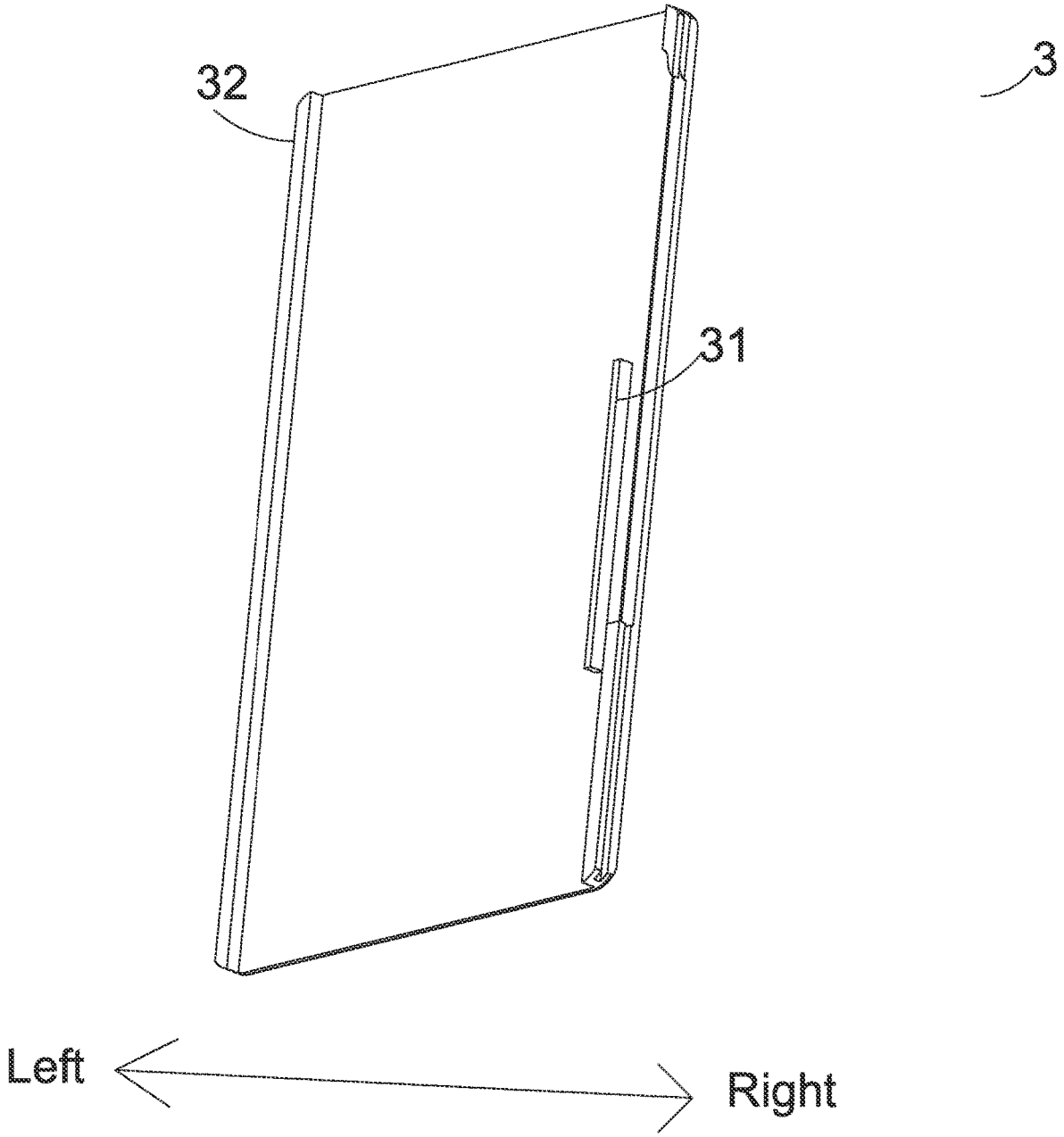
FIG. 4 is a schematic structural diagram of a holder cover of a push-type card holder according to the present application.

Further, please refer to FIG. 4, the holder cover 3 is provided with a second installation slot 32 corresponding to the first installation slot 26, for the matching installation of the holder cover 3 and the holder body 2.

In one embodiment, in order to facilitate the installation and positioning of the holder cover 3 and the holder body 2, a positioning column 31 is further provided on the holder cover 3.

Specifically, during installation, first place the second drive rod 11 in the gap between the rod body of the mounting rod 25 and the left folded edge of the holder body 2, and set the push boss 18 below the rod body of the mounting rod 25, and then set the first drive rod 13 to correspond to the push slot 27, and then install the push rod 12 and the limit rod 14. At this time, the installation of the card pushing assembly 1 is completed, and then place the second installation slot 32 in the first installation slot 26, and then place the positioning column 31 in the gap between the second drive rod 11 and the left side of the holder body 2, and then push the holder cover 3 along the first installation slot 26 until the holder cover 3 completely enters the holder body 2, and a push-type card holder can be installed.

The workflow of the present application is as follows:

When the card needs to be taken out from the holder body 2, the button 131 is toggled downward, the first drive rod 13 moves downward away from the limit rod 14, and drives the limit rod 14 to rotate around the fixed column 23 as a rotating shaft in the direction of approaching the first limit block 21, and the limit rod 14 is away from one end of the first drive rod 13. The distance from the folded edge on the right side of the holder body 2 will increase with the rotation of the limit rod 14. When the first drive rod 13 moves downward until it abuts against the second drive rod 11, the second drive rod 11 will move downward with the movement of the first drive rod 13. When the second drive rod 11 moves to the end of the push boss 28 against the push rod 12, the second drive rod 11 will push the end of the push rod 12 close to the second drive rod 11, and the push rod 12 will rotate around the push rob 17 as the rotation shaft, so that the angle between the push rod 12 and the second drive rod 11 is reduced (that is, the end of the push rod 12 away from the second drive rod 11 is lifted up). Continue to push the button 131 downward, the pushing force exerted by the second drive rod 11 on the push rod 12 gradually increases, the angle between the push rod 12 and the second drive rod 11 gradually decreases, so that the raised height of the end of the push rod 12 away from the second transmission rod 11 is gradually increased. At the same time, since the push rod 12 is provided with at least one step, the cards can be pushed out of the holder body 2 in a distributed manner under the push force of the push rod 12. When the card is pushed out of the holder body 2, if the distance between the end of the limit rod 14 away from the first drive rod 13 and the folded edge on the right side of the holder body 2 is not enough to accommodate the card entering and exiting the holder body 2, the card will push the limit rod 14 to continue to rotate, until the limit rod 14 contacts the first limit block 21. At this time, the distance between the end of the limit rod 14 away from the first drive rod 13 and the folded edge on the right side of the holder body 2 reaches the maximum value. As long as the value is set larger than the width of the card, the card will be smoothly pushed out of the holder body 2 by the push rod 12.

When it is necessary to put the card into the holder body 2, manually push the card into the holder body 2. When a card abuts against the end of the push rod 12 away from the second drive rod 11, a push force is applied to the push rod 12, so that the push rod 12 rotates in the opposite direction around the push shaft 17 as a rotation shaft. At this time, the angle between the push rod 12 and the second drive rod 11 will increase, and the end of the push rod 12 close to the second drive rod 11 will drive the second drive rod 11 to move upward. When the angle between the push rod 12 and the second drive rod 11 reaches the maximum value (the angle between the push rod 12 and the second drive rod 11 is about 90°), the card can be completely placed into the holder body 2. Then push the button 131 upward, the first drive rod 13 moves upward, and drives the limit rod 14 to rotate in the direction close to the second limit block 22. Continue to push the button 131 upward, the first drive rod 13 continues to move upward, and the limit rod 14 continues to rotate in the direction close to the second limit block 22. When the limit rod 14 reaches the position where it contacts the second limit block 22, the wedge-shaped structure of the first drive rod 13 will lock the limit rod 14. At this time, the button 131 can no longer be moved upward, and the distance between the end of the limit rod 14 away from the first drive rod 13 and the folded edge on the right side of the holder body 2 only needs to be less than the width of the card, the card will not leak out of the holder body 2 at will, which is very simple and practical.

The present application provides a push-type card holder, which can push out and place cards without elastic components for transmission, avoids damage to the card holder caused by the aging of elastic components caused by relying on elastic components for transmission, and saves maintenance costs and replacement costs, protect the environment, and the structure is simple, easy to install and maintain.

Further, when the holder body 2 accommodates cards, the cards will not leak out due to the action of the limit rod 14, and because the push rod 12 is provided with at least one step, the cards in the holder body 2 can be pushed out dispersedly, which increases the applicable scene and user experience of the card holder.

Further, the end of the first drive rod 13 close to the limit rod 14 is configured to be a wedge-shaped structure with a narrow upper part and a wider lower part. In this way, the direction of the force applied by the first drive rod 13 to the limit rod 14 can form an included angle with the axial direction of the fixed column 23, so as to ensure that the limit rod 14 will surely rotate around the fixed column 23 as a rotating shaft, when the first drive rod 13 pushes the limit rod 14. And when the first drive rod 13 is tenoned with the limit rod 14, the wedge-shaped structure of the first drive rod 13 will lock the limit rod 14, so as to achieve the technical effect of avoiding the accidental rotation of the limit rod 14 and the leakage of the card from the holder body 2. At the same time, the wedge-shaped structure with the narrow upper part and the wider lower part also makes it easy to move the first drive rod 13 downward.

Although the embodiments of the present application have been shown and described, it will be understood by those skilled in the art that various changes, modifications, substitutions and variants can be made in these embodiments without departing from the principles and spirit of the present application. The scope of the present application is defined by the appended claims and their equivalents.

In the description of this specification, reference to the description of the terms "one embodiment", "another embodiment", "example", etc. means that a particular feature, structure, material or characteristic described in connection with the embodiment or example is included in the present specification in at least one embodiment or example of the application. In this specification, schematic representations of the above terms do not necessarily refer to the same embodiment or example.

Furthermore, the particular features, structures, materials or characteristics described may be combined in any suitable manner in any one or more embodiments or examples.

The further embodiments of the present application disclosed above are provided only to aid in the illustration of the present application. The further embodiments do not exhaust all the details nor limit the application to the specific embodiments described. Obviously, many modifications and variations are possible in light of the content of this specification. These embodiments are selected and described in this specification in order to better explain the principles and practical applications of the present application, so that those skilled in the art can well understand and utilize the present application.

What is claimed is:

1. A push-type card holder comprising a holder body, a holder cover and a card pushing assembly, the card pushing assembly is arranged in the holder body, wherein the card pushing assembly comprises a first drive rod and a second drive rod, the first drive rod is arranged above the second drive rod;

the card pushing assembly further comprises a limit rod, which is arranged above the first drive rod by means of a fixed column, and can rotate around the fixed column as a rotating shaft;

the card pushing assembly further comprises a push rod, the push rod is arranged below the second drive rod, the push rod is provided with at least one step, and can be rotated relative to the second drive rod;

the first drive rod moves downward until it abuts against the second drive rod, and drives the second drive rod to move downward and the limit rod rotates in a direction close to a first limit block, and the second drive rod abuts against one end of the push rod and drives the push rod to rotate, and an included angle between the push rod and the second drive rod is reduced.

2. Push-type card holder according to claim 1, wherein the holder body is further provided with a first limit block and a second limit block, and the limit rod is arranged between the first limit block and the second limit block.

3. Push-type card holder according to claim 2, wherein the limit rod is an arc rod.

4. Push-type card holder according to claim 1, wherein an end of the first drive rod close to the limit rod is a wedge-shaped structure with a narrow upper part and a wider lower part.

5. Push-type card holder according to claim 1, wherein the card pushing assembly further comprises a fixed seat, and one end of the push rod close to the second drive rod is rotatably connected to the fixed seat by means of a push shaft.

6. Push-type card holder according to claim 5, wherein a push boss is provided at end of the second drive rod close to the push rod.

7. Push-type card holder according to claim 1, wherein the card pushing assembly further comprises a buffer mechanism, and the buffer mechanism is arranged below the limit rod and is detachably connected to the first drive rod.

8. Push-type card holder according to claim 1, wherein two sides of the holder body are provided with folded edges, the folded edges of one side are provided with push slot, and the folded edges of the other side are provided with a first installation slot.

9. Push-type card holder according to claim 6, wherein the holder cover is provided with a second installation slot corresponding to the first installation slot.

* * * * *